US008500525B2

(12) United States Patent
Opoku et al.

(10) Patent No.: US 8,500,525 B2
(45) Date of Patent: Aug. 6, 2013

(54) ELEVATOR CEILING VENTILATION CAVITY

(75) Inventors: Daniel G. Opoku, Longueuil (CA); Murllo W. Bonilha, West Hartford, CT (US); Wenlong Li, Tolland, CT (US); Goldino Alves, South Windsor, CT (US); Vijay Jayachandran, West Hartford, CT (US)

(73) Assignee: Otis Elevator Company, Farmington, CT (US)

( * ) Notice: Subject to any disclaimer, the term of this patent is extended or adjusted under 35 U.S.C. 154(b) by 1518 days.

(21) Appl. No.: 11/631,136

(22) PCT Filed: Feb. 3, 2005

(86) PCT No.: PCT/US2005/006615

§ 371 (c)(1),
(2), (4) Date: Dec. 28, 2006

(87) PCT Pub. No.: WO2006/011914

PCT Pub. Date: Feb. 2, 2006

(65) Prior Publication Data

US 2010/0126810 A1 May 27, 2010

(51) Int. Cl.
*B66B 11/024* (2006.01)
*G10K 11/161* (2006.01)
*F24K 2013/245* (2006.01)

(52) U.S. Cl.
USPC ..... 454/68; 454/254; 187/401

(58) Field of Classification Search
USPC ..... 454/68, 254; 187/401, 212, 224, 187/414; 52/302.1
See application file for complete search history.

(56) References Cited

U.S. PATENT DOCUMENTS 2,265,623 A * 12/1941 Bonsall ..... 454/88
2,310,414 A * 2/1943 Fritzam et al. ..... 454/68
2,350,389 A * 6/1944 Coulton et al. ..... 454/68

(Continued)

FOREIGN PATENT DOCUMENTS

JP 49-148648 4/1948
JP 58-191489 12/1983
JP 02305789 12/1990

OTHER PUBLICATIONS www.archive.com ; Jun. 15, 2004 image of silenceair.com website; product on sale by this date. See also US 2009/0011696.*

(Continued)

*Primary Examiner* — Steven B McAllister
*Assistant Examiner* — Frances H Kamps
(74) *Attorney, Agent, or Firm* — Carlson, Gaskey & Olds, PC

(57) ABSTRACT

An elevator cab ceiling includes an upper ceiling panel and a lower ceiling panel that are vertically spaced apart from each other with an intermediate ceiling cavity between them. An inlet duct is associated with the upper ceiling panel and an outlet duct is associated with the lower ceiling panel. The inlet and outlet ducts are horizontally spaced apart from each other and are fluidly connected to each other through the intermediate ceiling cavity to form a ventilation path. This separation of inlet and outlet ducts by an intermediate ceiling cavity reduces airborne noise transmissions that enter an elevator cab through the ventilation path. In one example, at least one baffle is installed within the intermediate ceiling cavity between the inlet and outlet ducts to interrupt a flow between the inlet and outlet to further reduce any transmitted noise.

25 Claims, 2 Drawing Sheets

U.S. PATENT DOCUMENTS

| | | | | | |
|---|---|---|---|---|---|
| 3,252,400 | A | * | 5/1966 | Madl, Jr. | 454/187 |
| 3,835,758 | A | * | 9/1974 | Bean | 454/236 |
| 3,913,702 | A | * | 10/1975 | Wirt et al. | 181/286 |
| 4,121,960 | A | * | 10/1978 | Focht | 156/219 |
| 4,258,615 | A | * | 3/1981 | Vivian | 454/229 |
| 4,287,962 | A | * | 9/1981 | Ingard et al. | 181/224 |
| 4,319,521 | A | * | 3/1982 | Gorchev et al. | 454/262 |
| 4,835,983 | A | * | 6/1989 | Chandler et al. | 62/259.1 |
| 5,080,003 | A | * | 1/1992 | Kappeler | 454/68 |
| 5,306,208 | A | | 4/1994 | Sommerrock | |
| 5,454,449 | A | * | 10/1995 | Makimattila et al. | 187/401 |
| 5,522,768 | A | * | 6/1996 | Brodt et al. | 454/234 |
| 6,099,406 | A | * | 8/2000 | Demster | 454/236 |
| 6,450,289 | B1 | * | 9/2002 | Field et al. | 181/224 |
| 7,284,640 | B2 | * | 10/2007 | Lee | 187/413 |
| 2005/0161280 | A1 | * | 7/2005 | Furuya | 181/225 |
| 2008/0190711 | A1 | * | 8/2008 | Patrick et al. | 187/401 |
| 2009/0011696 | A1 | * | 1/2009 | Matthews | 454/254 |

OTHER PUBLICATIONS

2007 Ashrae HAndbook—HVAC Applications—Sound and Vibration Control, chapter 47.13, figure 16.*

International Search Report and Written Opinion dated May 30, 2006.

* cited by examiner

ELEVATOR CEILING VENTILATION CAVITY

RELATED APPLICATION

This application is the U.S. national phase of PCT/US2005/06615, filed Mar. 2, 2005.

FIELD OF THE INVENTION

This invention generally relates to elevator systems. More particularly, this invention relates to elevator cab ceiling ventilation that has sound reduction characteristics.

DESCRIPTION OF THE RELEVANT ART

An elevator cab ceiling typically includes a ventilation duct or channel that allows airflow between an elevator cab and a hoistway. A ventilation fan facilitates airflow within the ventilation channel. Traditionally, the ventilation channel is formed as a vertical duct that extends straight through the ceiling. Typically, the ventilation channel extends straight down from an upper opening at a top portion of the elevator cab to a lower opening in the ceiling within the elevator cab.

An elevator machine includes a drive that operates a rope or belt system to move the elevator cab within the hoistway. Various noise sources such as the elevator machine, rope interaction with sheaves, rope vibration and radiation, and the ventilation fan generate noise that can be easily transmitted through the ventilation channel into the elevator cab. Such noise can disturb a passenger, and thus can be a detriment to perceived ride quality and comfort. The ventilation channel in the elevator ceiling is one of the main noise transmission paths. The typical ventilation channel provides a direct noise path into the elevator cab.

One prior solution to this problem involved using long air ducts lined with acoustic absorptive materials, however acoustic absorptive materials can be expensive and difficult to install. Another solution has been to use an active noise control system, which utilizes a speaker, microphones, and a controller to actively monitor and cancel noise generated during elevator operation. Disadvantages with these prior solutions include a lack of system robustness, need for regular maintenance, increased manufacturing and installation complexity, and failure to fully address all frequency bands of interest.

There is a need for an improved ventilation arrangement that provides reduced airborne noise transmission into an elevator cab. Disclosed embodiments of this invention utilize offset inlet and outlet ducts in combination with an intermediate ceiling ventilation cavity, which avoid the difficulties mentioned above.

SUMMARY OF THE INVENTION

In general terms, this invention is an elevator cab ceiling that includes offset inlet and outlet ventilation ducts to reduce noise levels and improve ride quality. An example ceiling includes an upper ceiling panel and a lower ceiling panel spaced apart from each other with an intermediate cavity between them. An inlet duct portion is associated with the upper ceiling panel and a separate outlet duct portion is associated with the lower ceiling panel. The intermediate cavity fluidly connects the inlet duct portion and the outlet duct portion to form a ventilation path. The combination of separate inlet and outlet duct portions and the intermediate cavity reduces airborne noise transmissions that might otherwise enter an elevator cab through the ventilation path, which improves ride quality.

In one example, the upper and lower ceiling panels are vertically spaced apart from each other to form the intermediate cavity. The inlet and outlet duct portions are horizontally spaced apart from each other and extend at least partially into the intermediate cavity. The inlet duct portion defines an inlet opening for air from an elevator hoistway and the outlet duct portion defines an outlet opening to direct air into an elevator cab. By horizontally spacing the inlet and outlet duct portions, the inlet and outlet openings are arranged in a non-overlapping relationship.

In one example, at least one baffle is installed within the intermediate cavity between the inlet and outlet duct portions to further reduce noise. The baffle reduces noise by interrupting an acoustic transmission path within the intermediate cavity. A plurality of baffles can also be used with at least one baffle being supported by the upper ceiling panel and at least one baffle being supported by the lower ceiling panel. By alternating baffles between the upper and lower ceiling panels, a serpentine flow path is formed and noise reduction characteristics are enhanced.

The elevator cab ceiling includes a unique ventilation channel that improves ride quality by reducing undesirable noise transmission into an elevator cab. The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENTS

Figure 1:
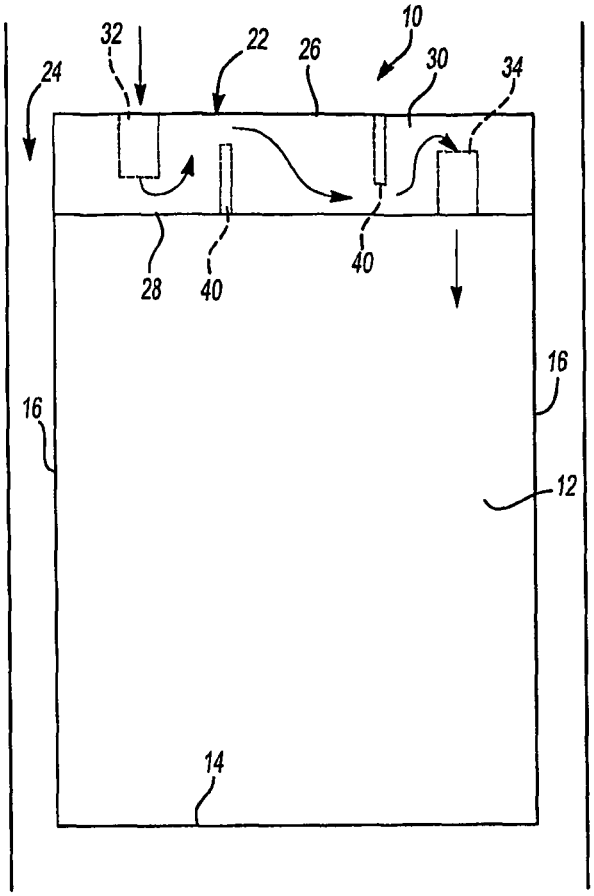
FIG. 1 schematically illustrates a side view of an elevator cab that has a two-panel ceiling designed according to an embodiment of this invention.
Figure 2:
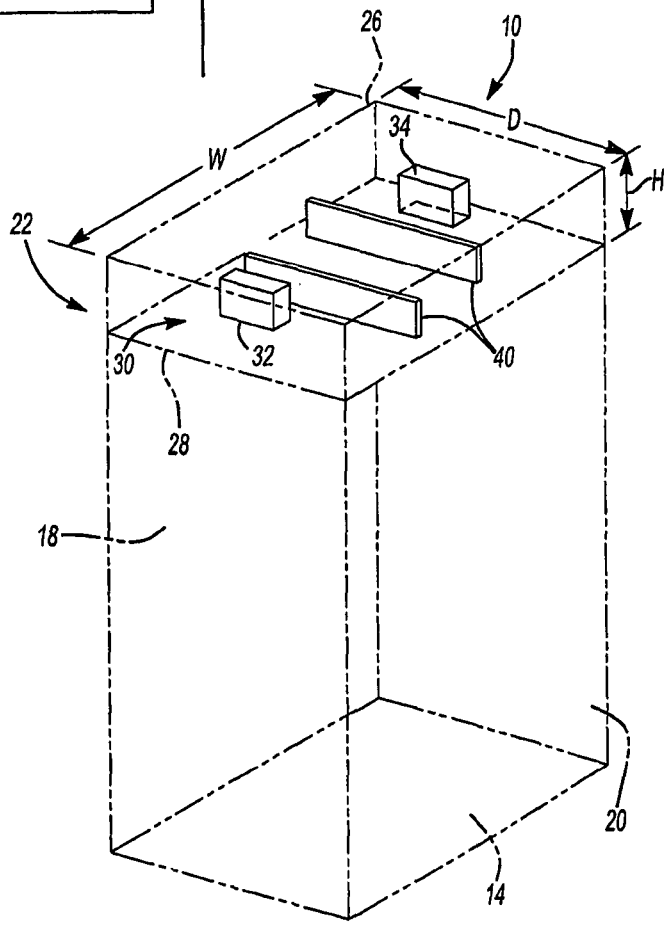
FIG. 2 is an isometric view of the elevator cab of FIG. 1.

As seen in FIGS. 1 and 2, an elevator cab 10 includes a passenger compartment 12 defined by a floor 14, a pair of side walls 16, a back wall 18, a front wall 20, and a ceiling 22. An elevator machine (not shown) is used to move the elevator cab 10 within an elevator hoistway 24.

The ceiling 22 includes a first ceiling panel 26 and a second ceiling panel 28. The first and second ceiling panels 26 and 28 are vertically spaced apart from each other and are positioned in an overlapping relationship. An intermediate ceiling cavity 30 exists between the ceiling panels 26 and 28. In this example, the ceiling panels 26 and 28 establish the walls of the cavity 30. In another example, a separate structure such as a large duct or channel is inserted between the ceiling panels 26 and 28.

A first duct portion 32 is associated with the first ceiling panel 26 and a second duct portion 34 is associated with the second ceiling panel 28. The first and second duct portions 32, 34 are separated and offset from each other by being horizontally spaced apart from each other. Each example duct portion extends at least partially within the intermediate ceiling cavity 30.

In the example shown in FIGS. 1 and 2, the first duct portion 32 includes an inlet opening that receives air from the elevator hoistway 24. The second duct portion 34 defines an outlet opening to direct air into the passenger compartment 12. By horizontally spacing the first and second duct portions 32, 34, the inlet and outlet openings are arranged in a non-overlapping relationship. The intermediate ceiling cavity 30 fluidly connects the first and second duct portions 32, 34 to form a ventilation path or channel.

The first and second duct portions 32, 34 are fractional or partial length ducts. This means that the first and second duct portions 32, 34 each have a length that is only a fractional dimension of the overall height between the first and second ceiling panels 26, 28. In the illustrated example, the first and second ceiling panels 26, 28 are separated by a first height and the length of the example first and second duct portions 32, 34 is less than the first height. Thus, there is no continuous duct extending directly downward from the first ceiling panel 26 to the second ceiling panel 28 to form the ventilation channel. Instead a discontinuous or fractional channel is formed by separating the first and second duct portions 32, 34. This discontinuous or fractional configuration provides significant noise attenuation capability because noises originated in the hoistway 26 cannot follow a straight, uninterrupted path directly into the cab 12.

The term "duct" as used in this description does not necessarily require a closed channel or a specific shape. The illustrated example includes generally rectangular ducts. Another example includes at least one duct wall positioned to deflect flow within the cavity 30 at least in the vicinity of the corresponding opening.

To further reduce noise, baffles 40 are installed within the example intermediate ceiling cavity 30. In the example shown, the baffles 40 are positioned between the first and second duct portions 32, 34 to interrupt a flow path from the inlet to the outlet. The baffles 40 can be supported by either the first or second ceiling panels 26, 28. In the example shown, the baffles 40 are alternately mounted to the first and second ceiling panels 26, 28 to form a generally serpentine flow path, allowing airflow to change direction multiple times.

As shown in FIG. 2, the intermediate ceiling cavity 30 is defined by a height dimension H, a depth dimension D, and a width dimension W. The baffles 40 are shown as being longer in the direction of the depth dimension D than the corresponding dimension of the first and second duct portions 32, 34. This configuration ensures that airflow is directed as needed within the intermediate ceiling cavity 30. It should be understood that while only a few baffles 40 are shown in FIGS. 1 and 2, only one baffle 40 may be required, or additional baffles 40 may be required depending on the desired level of noise reduction. Those skilled in the art who have the benefit of the description will be able to configure baffles to meet their particular needs.

Figure 3:
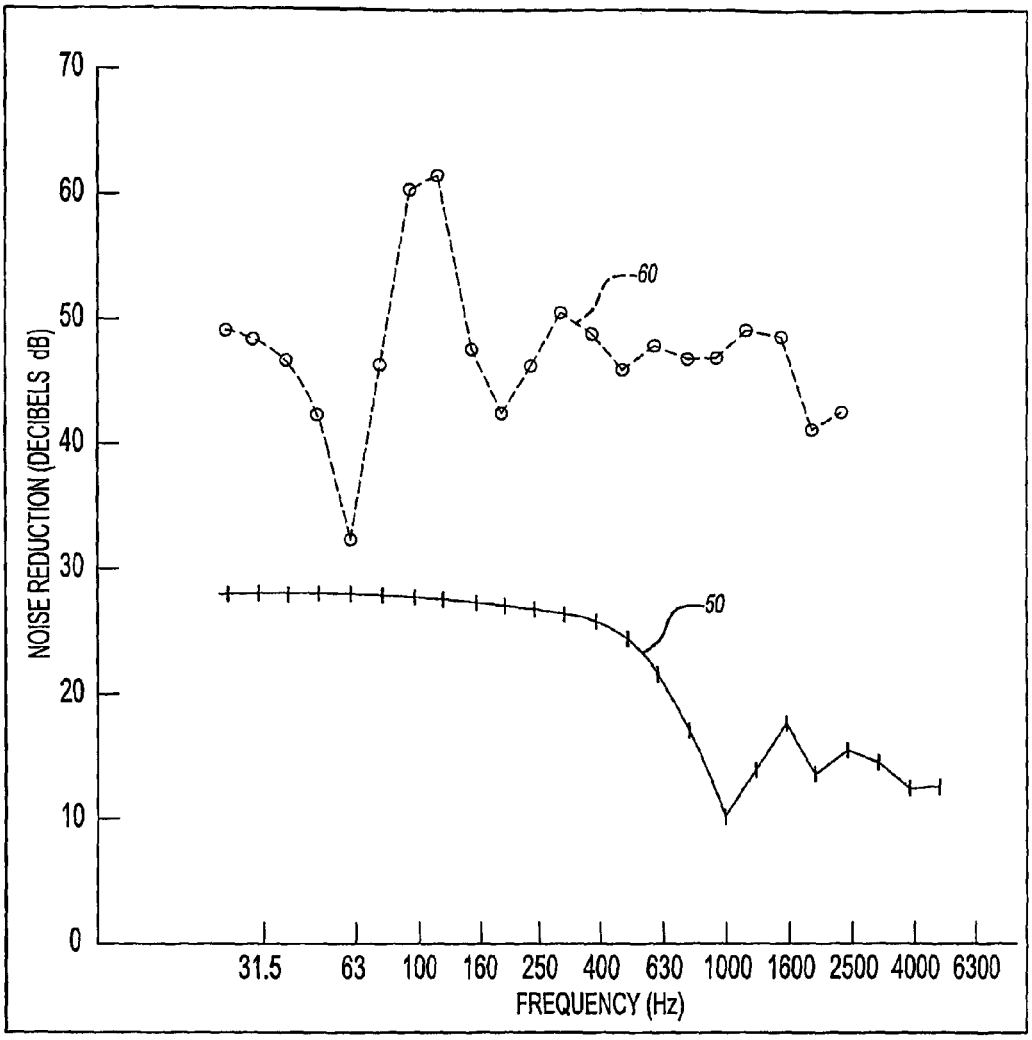
FIG. 3 is a graph of predicted noise reduction spectra comparing noise reduction for a traditional ventilation duct configuration and noise reduction for an elevator ceiling incorporating an embodiment of the subject invention.

FIG. 3 shows a graph of predicted noise reduction spectra for a frequency range of approximately 0 to 4000 Hz extending along the x-axis. The magnitude of noise reduction is shown on the y-axis in decibels (dB). The noise reduction for a traditional ventilation duct configuration is indicated at 50 and the noise reduction for an elevator ceiling 22 incorporating an embodiment of the subject invention is shown at 60. The maximum noise reduction 50 for the traditional ventilation duct configuration never exceeds a magnitude of 30 dB while the minimum noise reduction for the elevator ceiling 22 incorporating an embodiment of the subject invention is at least 30 dB. Thus, the concept of using offset partial length ducts located at the inlet and outlet openings provides significant noise reduction capability when compared to the traditional ventilation configuration.

The acoustic performance of this ventilation configuration can be increased by displacing the inlet and outlet openings within the intermediate ceiling cavity 30, and by adding baffles 40 located at selected positions within the intermediate ceiling cavity 30 to provide airborne noise reduction within an even wider frequency range. This configuration can be used in elevators of any duty, size, or speed. High speed and tighter hoistway elevator designs could especially benefit from this low-cost and simple method for reducing airborne noise transmission. Further, enhancements to noise reduction performance can be provided by adding acoustic absorption material and by increasing the thickness of the first and second ceiling panels 26, 28.

The displacement of the inlet and outlet openings relative to each other provides high-frequency noise reduction by directing high frequency acoustic waves along the interrupted path within the cavity 30. The baffles 40 provide increased high frequency noise reduction due to acoustic wave directivity, and can be tailored to modify the modal characteristics of the intermediate ceiling cavity 30. The location of the inlet and outlet openings within the first and second ceiling panels 26, 28 can be determined by using the Boundary Element Method (BEM) model simulation. The operation of this model simulation is well-known in the art. Further, the partial first and second duct portions 32, 34 act as waveguides, attenuating oblique incident sound waves at lower frequencies, resulting in increased noise reduction. In addition, the location of the inlet and outlet openings, and the lengths of the first and second duct portions 32, 34, can be tuned to avoid exciting particular modal frequencies of the intermediate ceiling cavity 30. One advantage of the disclosed configuration is that all of these noise reduction enhancements can be incorporated into a standard two-panel ceiling without adding different materials to the construction and with only minor changes to existing manufacturing processes. The construction can also accommodate light fixtures, however, an extra wall may be required between the intermediate ceiling cavity 30 and a fixture enclosure (not shown). Current mechanical and electrical interfaces with the elevator cab 10 will not have to be modified. Thus, a simple, low-cost, and robust ventilation channel configuration is provided that significantly reduces airborne noise when compared with traditional configurations.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

The invention claimed is:

1. An elevator ceiling comprising:

a first elevator car panel;

a second elevator car panel spaced apart from said first elevator car panel with an intermediate ceiling cavity between said first and second elevator car panels;

an inlet duct associated with said first elevator car panel; and an outlet duct associated with said second elevator car panel and not connected to said inlet duct, said inlet and said outlet ducts each extending at least partially into said intermediate ceiling cavity with said outlet duct being horizontally offset from said inlet duct, wherein said intermediate ceiling cavity comprises a ventilation path between said inlet and outlet ducts;

wherein said intermediate ceiling cavity includes a plurality of baffles horizontally spaced apart from each other within said intermediate ceiling cavity with at least one baffle being supported by said first elevator car panel and at least one baffle being supported by said second elevator car panel; and wherein said baffles alternate between being supported by said first elevator car panel and said second elevator car panel within said intermediate cavity between said inlet and said outlet duct portions to form a serpentine flow path between said inlet and said outlet openings.

2. The elevator ceiling of claim 1, wherein said inlet duct and said outlet duct are positioned in a non-overlapping arrangement.

3. The elevator ceiling of claim 1, wherein said first and said second elevator car panels are vertically spaced apart from each other and said inlet duct and said outlet duct are horizontally spaced apart from each other.

4. The elevator ceiling of claim 1, wherein said first and said second elevator car panels are spaced apart from each other by a first dimension and wherein said inlet duct has a second dimension and said outlet duct has a third dimension, said second and said third dimensions each being less than said first dimension.

5. The elevator ceiling of claim 1, including at least one baffle positioned within said intermediate ceiling cavity between said inlet and said outlet ducts.

6. The elevator ceiling of claim 5, including a plurality of baffles wherein each baffle is spaced apart from an adjacent one of the baffles.

7. The elevator ceiling of claim 6, wherein said plurality of baffles includes at least a first baffle supported by said first elevator car panel and a second baffle supported on said second elevator car panel independently from said first baffle to form a generally serpentine flow path around said first and said second baffles.

8. The elevator ceiling of claim 1, wherein said intermediate ceiling cavity is defined by a height, and wherein said inlet and said outlet ducts each comprise discrete fractional length ducts having lengths less than said height of said ceiling and having distal ends that are not connected to each other and that extend axially beyond one another in a direction corresponding to the height and wherein the ducts are offset from each other to provide airborne noise reduction by interrupting direct air flow from said inlet duct to said outlet duct.

9. The elevator ceiling of claim 1, wherein said inlet duct includes an opening to an upper surface of said first elevator car panel, and wherein air is movable in a vertical direction through said opening, along said ventilation path, and out said outlet duct.

10. The elevator ceiling of claim 1, wherein said inlet and said outlet ducts each extend into said intermediate ceiling cavity and each terminate at a discrete distal end, and wherein said inlet duct and said outlet duct each have an opening in said distal end that are not connected to each other such that there is not a single duct structure extending directly from said first elevator car panel to said second elevator car panel.

11. The elevator ceiling of claim 1, wherein said inlet duct and said outlet duct extend into said intermediate ceiling cavity such that discrete distal ends of said inlet and outlet ducts extend beyond one another.

12. The elevator ceiling of claim 11, wherein said intermediate ceiling cavity is defined by a height extending between said first and said second elevator car ceiling panels, and wherein said discrete distal ends of said inlet and outlet ducts extend axially beyond one another in a direction corresponding to said height.

13. An elevator comprising:

an elevator cab movable within a hoistway, said elevator cab including an upper ceiling panel;

a lower ceiling panel spaced apart from and positioned in an overlapping relationship with said upper ceiling panel to form an intermediate cavity between said upper and lower ceiling panels;

a ventilation channel including an inlet duct portion associated with said upper ceiling panel and having an inlet opening into said intermediate cavity, and an outlet duct portion associated with said lower ceiling panel and not connected to said inlet duct, said outlet duct having an outlet opening allowing airflow out of said intermediate cavity, said inlet and said outlet duct portions each extending at least partially into said intermediate cavity, and wherein said inlet duct portion and said inlet opening are separated from said outlet duct portion and said outlet opening;

wherein said inlet and said outlet openings are horizontally offset from each other within said intermediate cavity;

where said elevator includes a plurality of baffles horizontally spaced apart from each other within said intermediate cavity with at least one baffle being supported by said upper ceiling panel and at least one baffle being supported by said lower ceiling panel; and where said baffles alternate between being supported by said upper ceiling panel and said lower ceiling panel within said intermediate cavity between said inlet and said outlet duct portions to form a serpentine flow path between said inlet and said outlet openings.

14. The elevator of claim 13, wherein said upper ceiling panel and said lower ceiling panel are vertically separated from each other by a cavity height and wherein said inlet duct portion and said outlet duct portion each have lengths that are less than said cavity height.

15. The elevator of claim 13, wherein said upper and said lower ceiling panels are vertically spaced apart from each other and said inlet and outlet duct portions are horizontally spaced apart from each other.

16. The elevator of claim 13, including at least one baffle positioned within said intermediate cavity between said inlet and said outlet openings to reduce noise by interrupting a direct flow path between said inlet and said outlet openings.

17. The elevator of claim 13, wherein said inlet and outlet duct portions form discrete, fractional channels that are horizontally offset from each other such that airborne noise is reduced as air flows in a vertical direction into said inlet opening.

18. The elevator ceiling of claim 13, wherein said inlet duct extends at least partially into said intermediate cavity to terminate at an inlet duct end and said outlet duct portion extends at least partially into said intermediate cavity to terminate at an outlet duct end that is discretely located from and not connected to said inlet duct end.

19. The elevator ceiling of claim 18, wherein said inlet duct end and said outlet duct end extend axially beyond each other in a direction corresponding to a height of said intermediate cavity defined as a distance extending between said upper and lower ceiling panels.

20. A method for forming a ventilation path in an elevator ceiling comprising:

forming an intermediate cavity between an upper elevator ceiling panel and a lower elevator ceiling panel;

attaching a first duct portion with the upper elevator ceiling panel, the first duct portion defining an inlet;

attaching a second duct portion with the lower elevator ceiling panel, the second duct portion not being connected to the first duct portion and the second duct portion defining an outlet, and wherein the first and second duct portions each extend at least partially into the intermediate cavity;

reducing airborne noise by horizontally offsetting the second duct portion from the first duct portion;

flowing ventilation air from the first duct portion to the second duct portion with the intermediate cavity to form a ventilation path; and including installing at least one baffle being supported by said upper elevator ceiling panel and at least one baffle being supported by said lower elevator ceiling panel providing a multi-directional serpentine flow path between the first and second duct portions.

21. The method of claim 20, including positioning the at least one baffle within the intermediate cavity to optimize airborne noise reduction.

22. The method of claim 20, including providing a noise reduction of at least 30 dB.

23. The method of claim 20, including separating the first duct portion from the second duct portion to provide a discontinuous ventilation channel that prevents noise from flowing through a straight uninterrupted path from a hoistway at the first duct portion into an elevator cab interior at the second duct portion, and wherein the separating step includes extending the first and second duct portions to discrete distal ends located in the intermediate cavity, and providing the distal end of the first duct portion with an opening that is not connected to an opening provided in the distal end of the second duct portion such that there is not a single duct structure from the first elevator car panel to the second elevator car panel.

24. The method of claim 20, wherein said first and said second duct portions are not directly connected to each other.

25. The method of claim 20, including terminating the first duct portion at an inlet duct end located in the intermediate cavity and terminating the second duct portion at an outlet duct end located in the intermediate ceiling cavity, and axially extending the outlet duct end beyond the inlet duct end in a direction corresponding to a height of the intermediate cavity defined as a distance extending between the upper and lower elevator ceiling panels.

* * * * *

UNITED STATES PATENT AND TRADEMARK OFFICE

CERTIFICATE OF CORRECTION

PATENT NO. : 8,500,525 B2
APPLICATION NO. : 11/631136
DATED : August 6, 2013
INVENTOR(S) : Opoku et al.

It is certified that error appears in the above-identified patent and that said Letters Patent is hereby corrected as shown below:

ON THE TITLE PAGE:

Inventor Bonilha's information should read as follows:

--Murilo W. Bonilha, West Hartford, CT--

Signed and Sealed this
Fourth Day of March, 2014

Michelle K. Lee

Michelle K. Lee
*Deputy Director of the United States Patent and Trademark Office*